US008827835B1

(12) United States Patent
Griffin et al.

(10) Patent No.: US 8,827,835 B1
(45) Date of Patent: Sep. 9, 2014

(54) GOLF CLUB HEAD WITH SLOTS

(71) Applicant: Callaway Golf Company, Carlsbad, CA (US)

(72) Inventors: Sean G. Griffin, Carlsbad, CA (US); Philip G. Foster, Vista, CA (US)

(73) Assignee: Callaway Golf Company, Carlsbad, CA (US)

( * ) Notice: Subject to any disclaimer, the term of this patent is extended or adjusted under 35 U.S.C. 154(b) by 53 days.

(21) Appl. No.: 13/850,415

(22) Filed: Mar. 26, 2013

(51) Int. Cl.
*A63B 53/04* (2006.01)
*A63B 59/00* (2006.01)

(52) U.S. Cl.
CPC ..... *A63B 53/0466* (2013.01); *A63B 59/0092* (2013.01)
USPC ..... 473/332

(58) Field of Classification Search
USPC ..... 473/345, 332
See application file for complete search history.

(56) References Cited

U.S. PATENT DOCUMENTS

| | | | | |
|---|---|---|---|---|
| 4,754,974 | A * | 7/1988 | Kobayashi | 473/327 |
| 7,500,924 | B2 * | 3/2009 | Yokota | 473/332 |
| 7,988,565 | B2 * | 8/2011 | Abe | 473/328 |
| 8,608,587 | B2 * | 12/2013 | Henrikson et al. | 473/324 |
| 2003/0114244 | A1 * | 6/2003 | Matsunaga | 473/345 |
| 2008/0009365 | A1 * | 1/2008 | Krewalk et al. | 473/328 |

* cited by examiner

*Primary Examiner* — Michael Dennis
(74) *Attorney, Agent, or Firm* — Rebecca Hanovice; Michael A. Catania; Sonia Lari

(57) ABSTRACT

A golf club head having a plurality of slots that are strategically placed on its sole to enhance sound and reduce weight is disposed herein. In particular, the slots are disposed in a triangular pattern or around a triangular panel proximate the face.

9 Claims, 3 Drawing Sheets

GOLF CLUB HEAD WITH SLOTS

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a golf club head with acoustic voids. More specifically, the present invention relates to a golf club having slots disposed at certain locations on its crown and/or sole to improve the overall sound of the golf club head during use.

2. Description of the Related Art

The prior art discloses many different types of golf clubs with sound enhancing features, such as ribs. Ribs can be problematic, however, because they add unwanted mass to the golf club head. There is a need for golf club heads having both improved sound and a low weight to allow for the use of weight adjustment technologies.

BRIEF SUMMARY OF THE INVENTION

The present invention provides a novel golf club head having slots disposed at discrete locations on its crown and/or sole to improve sound. The slots remove mass from the golf club head and change the sound, and allow for sound adjustability.

One aspect of the present invention is a golf club head comprising a face, a crown, a sole, and a first plurality of slots, wherein the first plurality of slots is disposed in at least one of the crown and the sole, wherein the first plurality of slots comprises at least five discrete slots, and wherein at least one of the first plurality of slots extends parallel to the face and is disposed no more than 0.120 inch and no less than 0.020 inch from the face. In some embodiments, the first plurality of slots may be arranged in a triangular pattern. In a further embodiment, the golf club head may comprise a triangular panel, the sole may comprise a triangular recess sized to receive the triangular panel, and the triangular panel may be only partially affixed to the sole to form at least one of the first plurality of slots. In a further embodiment, the triangular panel may have a length of no more than 3 inches and a maximum width of no more than 2 inches.

In other embodiments, the golf club head may be selected from the group consisting of a driver-type golf club head, a fairway wood-type golf club head, and a hybrid-type golf club head. In some embodiments, at least one of the crown and the sole may be composed of a non-metal material such as a composite material. In a further embodiment, the face may be composed of a titanium alloy. In another embodiment, the golf club may comprise a second plurality of slots, each of which may be disposed less than 0.080 inch from the face, and each of which may extend perpendicular to the face. In another embodiment, the golf club head may further comprise a cross-shaped slot assembly located proximate the face. In some embodiments, at least one of the first plurality of slots may be disposed approximately 0.080 inch from the face.

Another aspect of the present invention is a wood-type golf club head comprising a metal face component, a sole comprising a recess, and a panel sized to fit within the recess, wherein the panel is only partially affixed to the sole, such that a plurality of slots is formed between the panel and the sole. In some embodiments, each of the sole and the panel may be composed of a metal material, and the panel may be welded to the sole. In another embodiment, each of the sole and the panel may be composed of a composite material, and the panel may be affixed to the sole with a permanent adhesive. In some embodiments, the recess may be triangular, and the plurality of slots may comprise at least five discrete slots. In other embodiments, at least one of the plurality of slots may be filled with a polymeric material.

Yet another aspect of the present invention is a driver-type golf club head comprising a metal face component comprising a striking face, a composite body comprising a crown and a sole, a first set of slots, and an elongated slot, wherein the first set of slots comprises at least three discrete slots arranged in a collinear configuration, wherein the first set of slots is disposed in at least one of the crown and the sole, and wherein the elongated slot is disposed proximate the face component and extends parallel to the striking face. In some embodiments, the elongated slot may be located no more than 0.120 inch and no less than 0.020 inch from the face component. In other embodiments, the first set of slots may be located no more than three inches from the striking face. In yet other embodiments, the first set of slots may be disposed in the sole.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is directed to a golf club head that includes a plurality of linear slots or voids in one or both of its crown and sole to reduce weight and improve sound. Adding slots or voids alters the structure without significantly affecting the golf club head shape and head mass, which in turn affects the acoustics of the golf club head. Sound can either be optimized or proliferated into various models to provide customization options. If the slots or voids must be sealed or covered according to U.S.G.A. rules, they can be closed with different materials from the primary head material to preserve the sound improvement.

Figure 1:
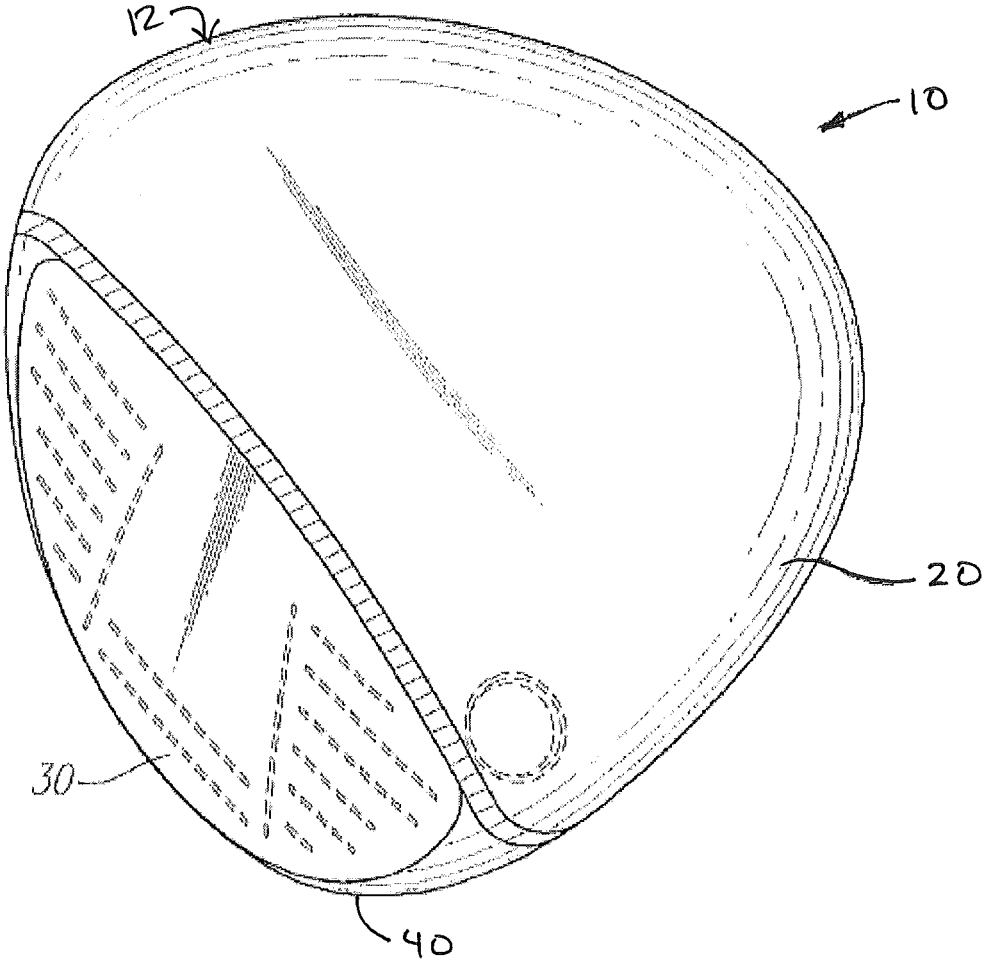
FIG. 1 is a top, perspective view of a first embodiment of the present invention.
Figure 2:
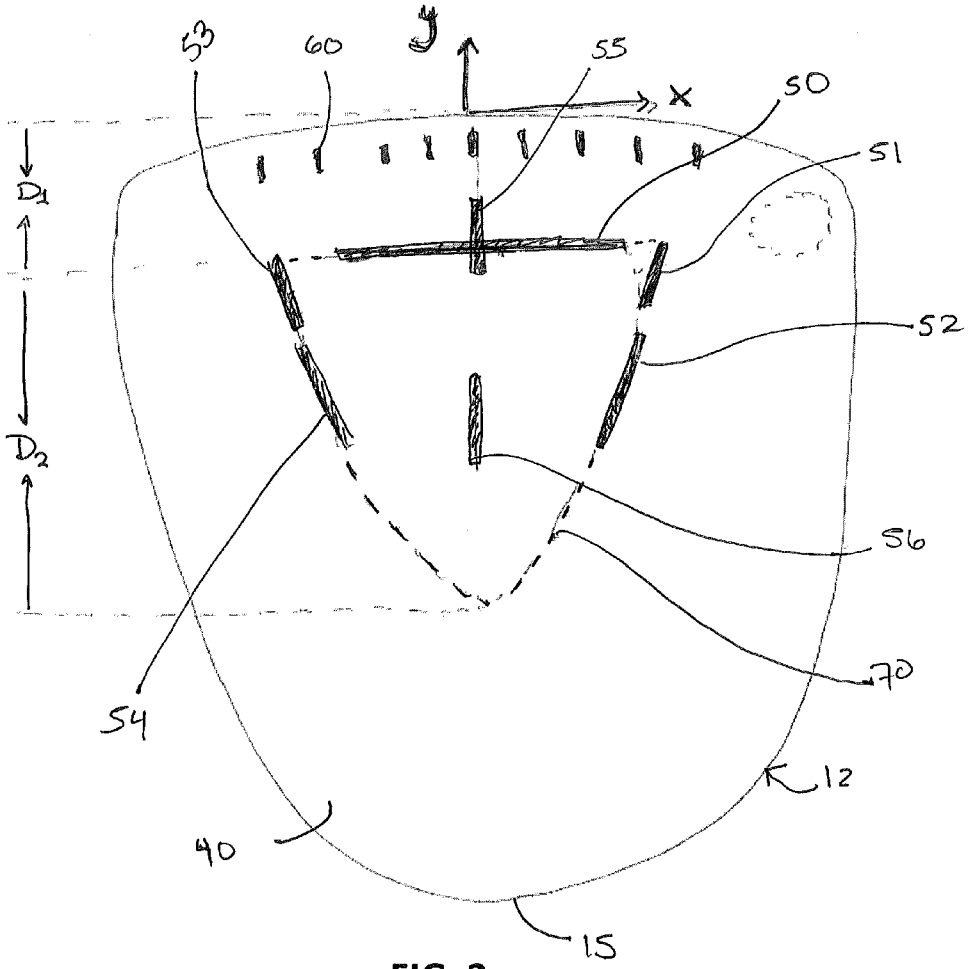
FIG. 2 is a sole, plan view of the embodiment shown in FIG. 1.

A preferred embodiment of the present invention is shown in FIGS. 1-2. As shown in these Figures, the golf club head 10 of the present invention is a driver-type head that comprises a body 12 with a crown 20, a face 30, and a sole 40. The sole 40 comprises a plurality of voids or slots 50, 51, 52, 53, 54, 55, 56 disposed in an approximately triangular pattern 70, which is spaced a distance $D_1$ from the face 30 and extends no more than a distance $D_2$ towards a rearmost portion 15 of the head 10. In the preferred embodiment, $D_1$ is approximately 0.080 inch, though in alternative embodiments it may range from 0.020 to 0.160 inch, and $D_2$ is no more than 3 inches. The preferred embodiment also includes a plurality of small slots 60 extending perpendicular to the face 30 and spaced less than 0.080 away from the face 30. In an alternative embodiment, the triangular pattern 70 is a separate panel which has a length $D_2$ and is affixed to the body, and the slots 50, 51, 52, 53, 54 are created by not bonding those areas of the triangular pattern 70 to the body.

In the preferred embodiment, slot 50, which extends parallel to the face 30, has a length of approximately 1 inch, but in an alternative embodiment, slot 50 has a length of approximately 2 inches. Slot 55 preferably extends perpendicular to the face 30 and intersects slot 50, though in an alternative embodiment slot 55 may extend at a non-perpendicular angle to the face and/or not intersect or extend through slot 50. Slots 51, 52, 53, 54 border the triangular pattern 70 or panel, and slot 56 is disposed centrally within the triangular pattern 70 or panel and extends perpendicular to the face 30.

Figure 3:
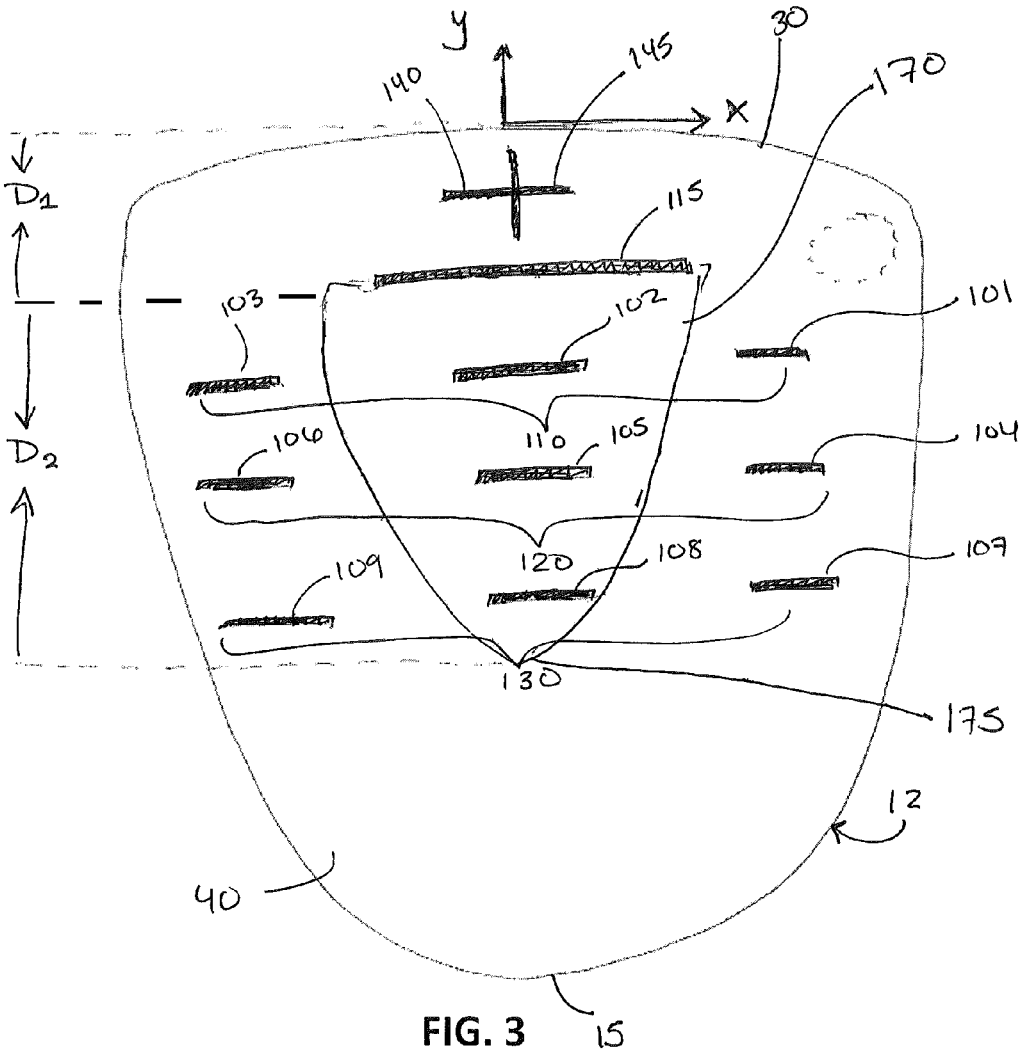
FIG. 3 is a sole, plan view of an alternative embodiment of the present invention.

An alternative embodiment of the present invention is shown in FIG. 3. In this embodiment, the golf club body 12 includes a triangular panel 170 around which the slots 101, 102, 103, 104, 105, 106, 107, 108, 109, 115, 140, 145 are assorted. As with the preferred embodiment, slot 115 is disposed a distance $D_1$ from the face 30 and extends parallel to the face. This slot 115 has a length of approximately 1 inch, but in an alternative embodiment has a length of 2 inches. The triangular panel 170 preferably has a length $D_2$ of no more than 3 inches, and a maximum width that is slightly longer than the length of slot 115. This embodiment also includes two slots 140, 145 that are disposed in a cross-like assortment proximate the face 30, and no more than 0.080 inch from the face 30.

The embodiment shown in FIG. 3 also includes three sets 110, 120, 130 of slots 101, 102, 103, 104, 105, 106, 107, 108, 109 disposed at even intervals across the sole 40 of the golf club body 12. As shown in FIG. 3, the first set 110 includes three slots 101, 102, 103 and is disposed proximate slot 115 at the front of the triangular panel 170. The second set 120 includes another three slots 104, 105, 106 and is disposed approximately at a midpoint along the sole 40, while the third set 130 includes slots 107, 108, 109 and is disposed proximate the rearward-most point 175 of the triangular panel 170. In alternative embodiments, the golf club head 10 may include one or more of the slot sets 110, 120, 130, and may forego the slots 140, 145 forming, the cross-shaped assortment proximate the face 30. In yet another embodiment, the golf club head shown in FIG. 3 includes only one of the slots 101, 102, 103, 104, 105, 106, 107, 108, 109, 115, 140, 145 shown therein, and the slot included in the head 10 is selected to best optimize sound and feel of the golf club head 10.

In an alternative embodiment, the golf club head 10 of the present invention is composed of a plurality of panels, each of which has a unique sound signature based on its shape and materials, the assembly of which creates one or more of the slots shown in the Figures hereto. In other embodiments, the slot configurations disclosed herein are disposed in the crown 20 instead of the sole 40. In each of the embodiments disclosed herein, the part of the body 12 in which the slots are disposed is preferably composed of a composite or other lightweight, non-metal material, though in further embodiments, the golf club head 10 may be made of any number of materials, including those material compositions disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein. The embodiments of the present invention may also be used in connection with fairway wood, hybrid, and iron type golf club heads.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising: a face; a crown; a sole; and a first plurality of slots, wherein the first plurality of slots is disposed in at least one of the crown and the sole, wherein the first plurality of slots comprises at least five discrete slots, wherein at least one of the first plurality of slots extends parallel to the face and is disposed no more than 0.120 inch and no less than 0.020 inch from the face; wherein the first plurality of slots is arranged in a triangular pattern; and further comprising a second plurality of slots, wherein each of the second plurality of slots is disposed less than 0.080 inch from the face, and wherein each of the second plurality of slots extends perpendicular to the face.

2. The golf club head of claim 1, further comprising a triangular panel, wherein the sole comprises a triangular recess sized to receive the triangular panel, and wherein the triangular panel is only partially affixed to the sole to form at least one of the first plurality of slots.

3. The golf club head of claim 2, wherein the triangular panel has a length of no more than 3 inches and a maximum width of no more than 2 inches.

4. The golf club head of claim 1, wherein the golf club head is selected from the group consisting of a driver-type golf club head, a fairway wood-type golf club head, and a hybrid-type golf club head.

5. The golf club head of claim 1, wherein at least one of the crown and the sole is composed of a non-metal material.

6. The golf club head of claim 5, wherein the non-metal material is a composite material.

7. The golf club head of claim 6, wherein the face is composed of a titanium alloy.

8. The golf club head of claim 1, further comprising a cross-shaped slot assembly located proximate the face.

9. The golf club head of claim 1, wherein the at least one of the first plurality of slots is disposed approximately 0.080 inch from the face.

* * * * *